US005568759A

United States Patent [19]

Aardema

[11] Patent Number: 5,568,759

[45] Date of Patent: Oct. 29, 1996

[54] HYDRAULIC CIRCUIT HAVING DUAL ELECTROHYDRAULIC CONTROL VALVES

[75] Inventor: James A. Aardema, Joliet, Ill.

[73] Assignee: Caterpillar Inc., Peoria, Ill.

[21] Appl. No.: 473,626

[22] Filed: Jun. 7, 1995

[51] Int. Cl.[6] ..... F15B 11/08; F15B 13/044

[52] U.S. Cl. ..... 91/461; 91/459; 91/462; 91/454

[58] Field of Search ..... 91/365, 454, 458, 91/459, 462, 465, 464, 461; 60/468

[56] References Cited

U.S. PATENT DOCUMENTS

| | | | |
|---|---|---|---|
| 886,633 | 5/1908 | Platz | 91/455 |
| 3,164,065 | 1/1965 | Frantz | 91/365 |
| 3,782,250 | 1/1974 | Kiszewski | 91/454 X |
| 5,095,804 | 3/1992 | Burch | 91/454 X |
| 5,138,838 | 8/1992 | Crosser | 91/465 X |
| 5,313,873 | 5/1994 | Gall et al. | 91/454 X |

FOREIGN PATENT DOCUMENTS

| | | | |
|---|---|---|---|
| 3125386 | 1/1983 | Germany | 91/461 |
| 1435856 | 11/1988 | U.S.S.R. | 91/454 |

*Primary Examiner*—Hoang Nguyen
*Attorney, Agent, or Firm*—John W. Grant

[57] ABSTRACT

A three position four way directional control valve having a single spool is typically used for controlling fluid flow from a pump to a cylinder and from the motor to a tank. The present invention includes a pair of electrohydraulic control valves with one of the control valves controlling pump-to-cylinder communication between a pump and the rod end and head end chambers of a hydraulic cylinder while the other control valve controls cylinder-to-tank communication between the rod end and head end chambers and the tank. Each of the control valves includes a displacement controlled proportional valve for controlling the position of a pilot operated valve member. Actuation of the hydraulic cylinder requires moving the valve member of one control valve to control pump-to-cylinder communication to one of the chambers while simultaneously moving the valve member of the other control valve for establishing cylinder-to-tank communication between the other chamber and the tank.

5 Claims, 1 Drawing Sheet

POSITION SENSOR
MICRO-PROCESSOR
17
18
19
21
22
23
24
26
27
28
29
31
32
33
34
36
37
38
39
41
42
43
44
46
47
48
49
51
52
53
54
56
57
58
59
61
62
10
11
12
13
14
16

HYDRAULIC CIRCUIT HAVING DUAL ELECTROHYDRAULIC CONTROL VALVES

DESCRIPTION

1. Technical Field

This invention relates generally to a hydraulic circuit and, more particularly, to a hydraulic circuit having a first electrohydraulic control valve for controlling pump-to-cylinder fluid flow to a hydraulic cylinder and a second electrohydraulic valve controlling cylinder-to-tank fluid flow.

2. Background Art

A hydraulic circuit for controlling a reversible hydraulic motor typically includes a three-position four-way control valve having a single spool for controlling fluid flow from a pump to the cylinder and from the cylinder to a tank. One of the problems encountered with such circuit is that the directional control valve commonly has a single spool with the timing of the metering slots designed to optimize the control of the pump-to-cylinder fluid flow. Thus, the spool is generally inadequate for metering cylinder-to-tank fluid flow in an overrunning load condition.

The problem noted above was solved somewhat by the disclosure of U.S. Pat. No. 5,138,838 which uses a pair of electrohydraulic control valves arranged so that each control valve controls fluid flow to and from only one port of a reversible hydraulic cylinder.

3. Disclosure of the Invention

In one aspect of the present invention, a hydraulic circuit having a pump, a supply tank, and a hydraulic cylinder having rod and head end chamber comprises a first electrohydraulic control valve connected to the pump and to the rod and head end chambers and having a neutral position blocking communication between the pump and both of the chambers and being movable in a first direction to establish pump-to-cylinder fluid communication between the pump and the rod end chamber and in a second direction to establish pump-to-cylinder fluid communication between the pump and the head chamber. A second electrohydraulic control valve is connected to the tank and to the rod and head end chambers and has a neutral position blocking communication between the rod and head end chambers and the tank and is movable in a first direction to establish cylinder-to-tank fluid communication between the rod end chamber and the tank and in a second direction to establish cylinder-to-tank communication between the head end chamber and the tank.

BRIEF DESCRIPTION OF THE DRAWINGS

The sole FIGURE is a schematic illustration of embodiment of the present invention.

BEST MODE FOR CARRYING OUT THE INVENTION

Figure 1:
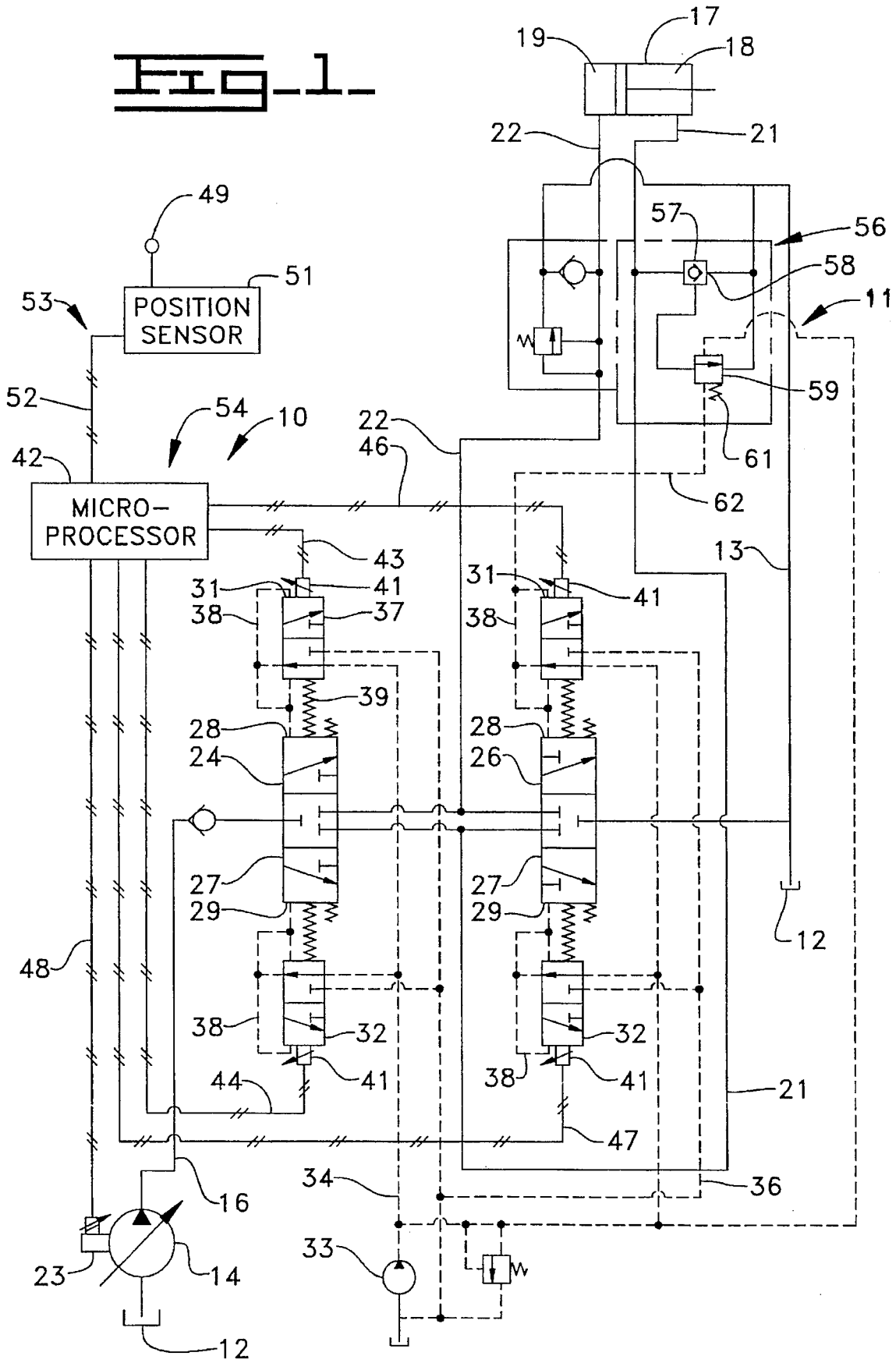

A control system 10 is shown in association with a hydraulic circuit 11 which includes a tank 12, an exhaust conduit 13 connected to the tank, a hydraulic pump 14 connected to the tank, a supply conduit 16 connected to the pump, a reversible hydraulic motor 17 in the form of a double-acting hydraulic cylinder having rod end and head end chambers 18,19, and a pair of motor conduits 21,22 connected to the rod end and head end chambers respectively. The pump 14 in this embodiment is a variable displacement pump having an electrohydraulic displacement controller 23 which is operative to control the displacement of the pump in response to receiving an electrical control signal with the extent of displacement being dependent upon the magnitude of the control signal. However, other pump arrangements such as a pressure compensated pump, a fixed displacement pump combined with a bypass valve, etc. can be substituted for the variable displacement pump.

An electrohydraulic proportional control valve 24 is connected to the pump through the supply conduit 16 and to the rod end and head chambers 18,19 through the motor conduits 21,22. Another electrohydraulic proportional control valve 26 is connected to the tank 12 through the exhaust conduit 13 and to the rod end and head end chambers 18,19 through the motor conduits 21,22.

Each control valve 24,26 includes a pilot operated valve member 27 having opposite ends 28,29 and being connected to the supply conduit 16 and to the motor conduits 21,22. Each control valve 24,26 also includes a pair of electrohydraulic proportional valves 31,32 both of which are connected to a source of pressurized pilot fluid such as a hydraulic pump 33 through a supply line 34 and to the tank 12 through an exhaust line 36.

Each of the proportional valves 31,32 is a displacement controlled proportional valve having a pilot spool 37 connected to the supply line 34, the exhaust line 36, and a pilot passage 38 commonly connected to the associated ends 28 or 29 of the valve members 27 and to both ends of the pilot spool 37. A feedback spring 39 disposed between the valve member 27 and the pilot spool 37 normally biases the pilot spool to a neutral or de-energized position shown to connect the supply line with the pilot passage. A solenoid 41 is disposed at the end of the pilot spool 37 opposite the spring 39. The proportional valves are disposed to modulatably control fluid pressure at the ends of the valve member. Each of the proportional valves has an energized position at which the associated end of the valve member is vented to the tank so that the valve member moves toward the energized proportional valve.

The control system 10 also includes a microprocessor 42 connected to the solenoids 41 of the proportional valves 31,32 through electrical lead lines 43,44,46,47 and to the displacement controller 23 through a lead line 48. A control lever 49 is operatively connected to a position sensor 51 which in turn is connected to the microprocessor through a lead line 52.

The control lever 49, the position sensor 51 and the lead line 52 provide a means 53 for outputting a command signal to establish a desired fluid flow rate and direction of fluid flow through both of the control valves 24,26.

The microprocessor 42 provides a control means 54 for processing the command signal, for producing first and second discrete control signals in response to the command signal, and for outputting the first control signal to one of the control valves 24,26 and the second control signal to the other of the control valves.

A pilot operated vent valve 56 is disposed between the motor line 21 and the exhaust conduit 13 and includes a pilot operated check valve 57 having a pilot port 58, and a pressure responsive actuating valve 59 connected to the pilot port 58 and to the exhaust line 13. The actuating valve has a spring 61 disposed at one end resiliently biasing the actuating valve to the position shown. A pilot line 62 connects the spring end of the actuating valve with the pilot passage 38 of the proportional valve 31 of the control valve 26. The other end of the actuating valve 59 is connected to the supply line 34.

Actuation of both of the control valves 24,26 in either direction is obtained in substantially the same way. Thus, movement of the valve member 27 of the control valve 24 will be described in detail. Movement of the valve member 27 upward, for example, is initiated by directing an electrical control signal to the solenoid 41 of the proportional valve 31 which in turn exerts a control force against the pilot spool 37 proportional to the strength of the electrical signal. The control force moves the pilot spool downward against the bias of the feedback spring 39 to initially block communication between the pump 33 and the pilot passage 38 and subsequently communicating pilot passage 38 with the tank 12 through the line 36 to vent the pressure at the end 28 of the valve member 27. This reduces the pressure level at the end 28 so that the force of the pressurized fluid acting on the end 29 moves the valve member 27 upward to establish pump-to-cylinder communication between the pump and the rod end chamber 18. The upward movement of the valve member 27 compresses the feedback spring 39 which exerts a feedback force against the pilot spool 37 to counteract the control force exerted on the pilot spool by the solenoid 41. The upward movement of the valve member 27 will continue until the feedback force and the control force acting on the pilot spool are in equilibrium. At that point, upward displacement of the valve member 27 is proportional to the level of the control force exerted on the pilot 35 valve 37 by the solenoid.

Industrial Applicability

In operation, when the control lever 49 is in the centered position shown, a neutral command signal is being transmitted through the signal line 52 to the microprocessor 42. When the microprocessor is receiving the neutral command signal, no control signals are being outputted through any of the signal lines such that the valve members 27 of the control valves 24,26 are in their neutral position to hydraulically lock the hydraulic cylinder 17 in a fixed position. Also when no command signal is being received by the displacement controller 23, the displacement of the pump is reduced to a position to maintain a low standby pressure in the supply conduit 16.

To extend the hydraulic cylinder 17, the control lever 49 is moved rightward an amount corresponding to the speed at which the operator wants to the motor to extend. In so doing, the position sensor 51 senses the operational position of the lever 49 and outputs a command signal to establish the direction of fluid flow and fluid flow rate through both control valves 24 and 26 to achieve the desired extension speed of the hydraulic cylinder. The command signal is transmitted through the lead line 52 to the microprocessor which processes the command signal and produces first and second discrete valve control signals in response to the command signal and outputs the first and second valve control signals through the lead lines 44 and 47 respectively. The control signals energize the solenoids 41 of the proportional valves 32 of both control valves 24 and 26. A control signal is also directed through the lead line 48 to the displacement controller 23 to increase the displacement of the pump 14 to match the desired flow rate. Energizing the solenoid 41 of the proportional valve 32 of the control valve 24 moves the valve member 27 thereof downward to establish pump-to-cylinder fluid communication between the pump and the head end chamber 19. Similarly energizing the solenoid 41 of the proportional valve 32 of the control valve 26 causes downward movement of the valve member 27 thereof to establish cylinder-to-tank communication between the rod end chamber 18 and the tank 12.

Retraction of the hydraulic cylinder 17 is similarly initiated by moving the control lever 49 leftward to simultaneously energize the solenoids 41 of the proportional valves 31 of the control valves to move both valve members upward to establish pump-to-cylinder fluid communication between the pump and the rod end chamber 18 and to establish cylinder-to-tank communication between the head end chamber 19 and the tank 12.

The vent valve 56 is operational in combination with the control valve 26 to provide a float function. More specifically, fully energizing the solenoid of the proportional valve 31 of the control valve 26 reduces the pressure in the pilot passage 38 thereof sufficiently for the valve member 27 to move upward to establish cylinder-to-tank communication between the head end chamber 19 and the tank 12. The pressure in the line 62 also decreases to a level to cause the vent valve 59 to move downward to a position to vent the pilot port 58 to the tank 12. This allows the pilot operated check valve 57 to open establishing communication between the motor conduit 21 and the exhaust conduit 13 so that both ends of the cylinder communicate with the tank. Energizing the solenoid of the proportional valve 31 of the control valve 26 can be energized by a switch, not shown, in a well known manner.

In view of the above, it is readily apparent that the structure of the present invention provides an improved hydraulic circuit in which a first electrohydraulic control valve controls pump-to-cylinder fluid communication between the pump and both of the actuating chambers of a hydraulic cylinder and a second electrohydraulic control valve controls cylinder-to-tank communication between the actuating chambers and the tank.

Other aspects, objects and advantages of this invention can be obtained from a study of the drawings, the disclosure and the appended claims.

I claim:

1. A control system for a hydraulic circuit having a pump, a supply tank, a source of pilot fluid and a hydraulic cylinder having rod end and head end chambers comprising:

a first electrohydraulic control valve connected to the pump and to the rod and head end chambers and being movable from a neutral position in a first direction to establish pump-to-cylinder fluid communication between the pump and the rod end chamber and in a second direction to establish pump-to-cylinder fluid communication between the pump and the head end chamber;

a second electrohydraulic control valve connected to the tank and to the rod and head end chambers and being movable in a first direction from a neutral position to establish cylinder-to-tank fluid communication between the rod end chamber and the tank and in a second direction to establish cylinder-to-tank communication between the head end chamber and the tank, each of the control valves including a pilot operated valve member having first and second ends and a pair of proportional valves connected to the source of pilot fluid and disposed to modulatably control fluid pressure at the ends of the valve member; and a pilot operated vent valve having a closed position blocking communication between the rod end chamber and the tank and an open position establishing communication between the tank and the rod end chamber, the vent valve being moved to the second position in response to the second control valve being moved in the first direction.

2. The control system of claim 1 wherein the vent valve includes a pilot operated check valve having a pilot port and a pressure responsive valve having one end connected to the source of pilot pressure, a spring at the other end biasing the pressure responsive valve to a position blocking communication between the pilot port and the tank, and a pilot line connecting the spring end to the first end of the valve member of the second control valve.

3. The control system of claim 1 wherein the proportional valves are displacement controlled proportional valves having a pilot spool and a feedback spring disposed between the pilot spool and the valve member.

4. The control system of claim 3 wherein each of the proportional valves includes a pilot passage connected to an associated end of the valve member, the proportional valve having a de-energized position at which pilot fluid is directed to the ends of the valve member.

5. The control system of claim 4 wherein each of the proportional valves has an energized position at which the associated end of the valve member is vented to the tank so that the valve member moves toward the energized proportional valve.

* * * * *